United States Patent [19]

Sherman et al.

[11] Patent Number: 4,592,190

[45] Date of Patent: Jun. 3, 1986

[54] SLEEVE CARTON END PANEL AND FLAP FOLDING AND SEALING ASSEMBLY

[75] Inventors: Earle C. Sherman; James B. P. Green, Jr., both of West Monroe, La.

[73] Assignees: Johns-Manville Corporation, Denver, Colo.; Southern Tool Company, Inc., West Monroe, La.

[21] Appl. No.: 710,450

[22] Filed: Mar. 11, 1985

Related U.S. Application Data

[62] Division of Ser. No. 501,953, Jun. 7, 1983, Pat. No. 4,519,181.

[51] Int. Cl.[4] ..... B65B 57/02

[52] U.S. Cl. ..... 53/491; 53/77; 493/31

[58] Field of Search ..... 53/491, 383, 374, 381 R, 53/77, 52, 387; 493/38, 30–33, 3, 183; 83/289

[56] References Cited

U.S. PATENT DOCUMENTS

| | | | |
|---|---|---|---|
| 3,354,797 | 11/1967 | Hickin | 53/491 X |
| 3,504,478 | 4/1970 | Dieter | 53/209 X |
| 4,480,421 | 11/1984 | Rece | 53/374 X |

*Primary Examiner*—James F. Coan

*Attorney, Agent, or Firm*—Bachman & LaPointe

[57] ABSTRACT

In a carton erecting, loading and sealing machine for packaging a plurality of articles in a sleeve type carton, the gluing and sealing station of the machine is provided with a pair of upper folding plates and a pair of lower folding plates on either side of the carton conveyor for folding the upper and lower end panels of the cartons against the dust flaps of the cartons after glue has been applied to seal the cartons. Each folding plate is mounted through rotatable mountings to a pair of cranks which move the folding plates downstream as the plates fold and seal the end panels to the dust flaps.

4 Claims, 10 Drawing Figures

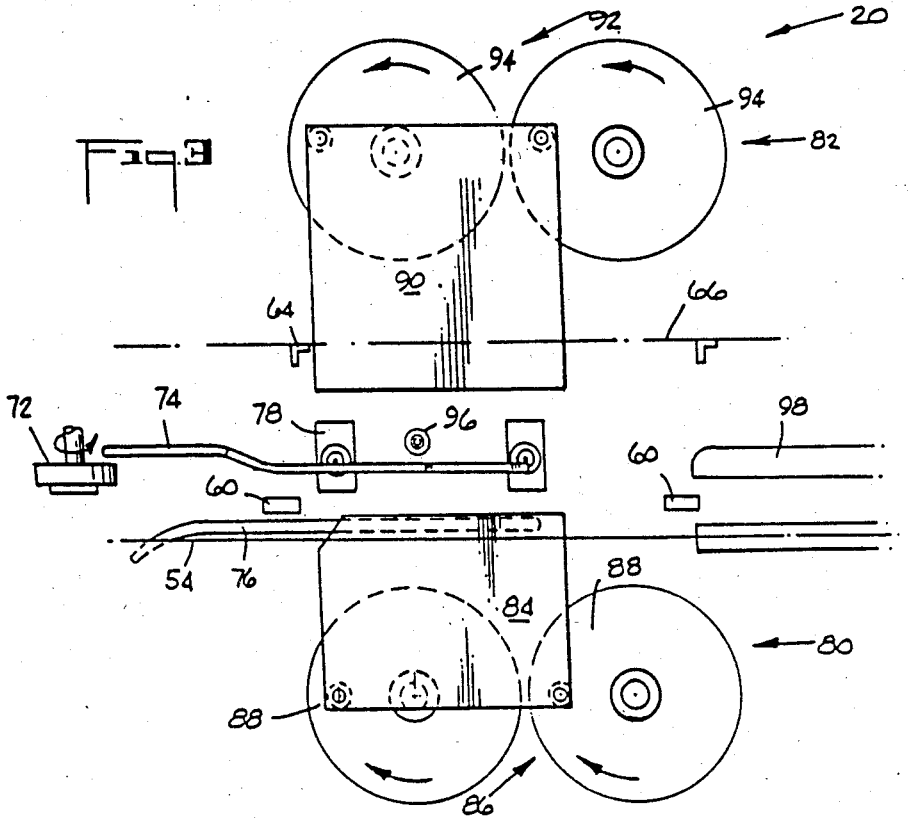
20
92
94
94
82
90
64
66
72
74
78
96
98
60
60
54
76
88
84
80
88
86
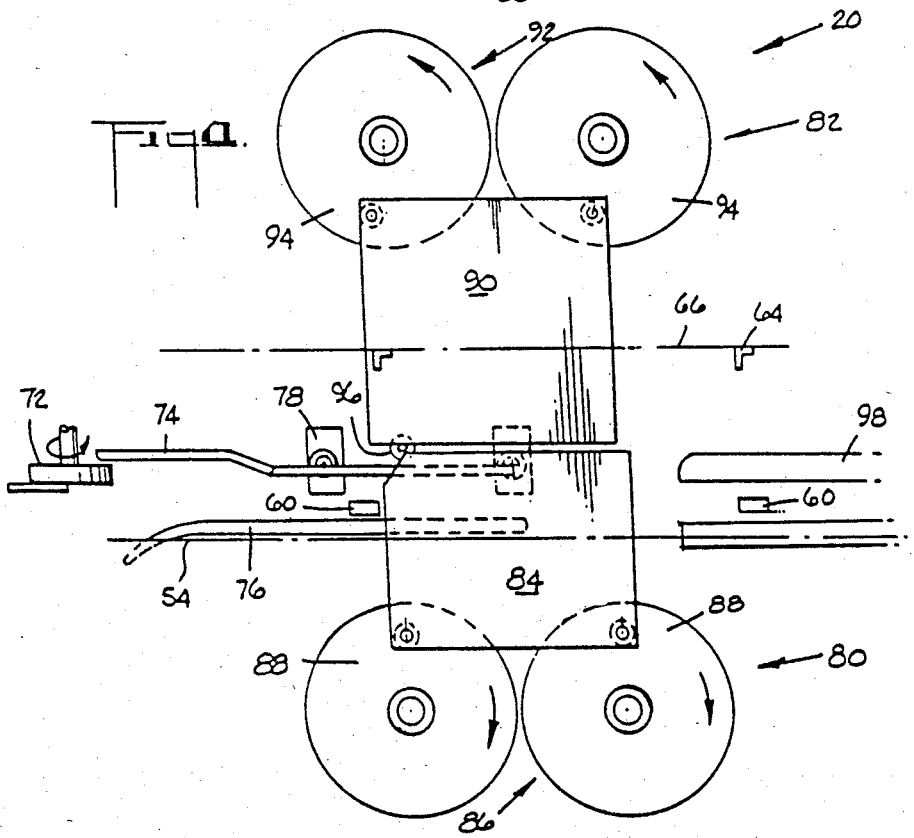
20
92
82
94
94
90
66
64
72
74
78
96
98
60
60
54
76
84
88
88
80
86

94
92
94
20
82
90
64
66
72
74
96
78
98
60
76
60
54
84
80
88
88
86

82'
92'
90'
20
82
92
90
66
64
66
78'
78
74'
24
74
76'
76
60
54
84'
84
80'
80
86'
86

82'
94'
92'
90
20
82
94
92
90
66
64
78
78
74
24
60
76
84'
54
76
60
84
88
88
80'
86'
80
86

SLEEVE CARTON END PANEL AND FLAP FOLDING AND SEALING ASSEMBLY

This is a division, of application Ser. No. 501,953 filed June 7, 1983, now U.S. Pat. No. 4,519,181.

BACKGROUND OF THE INVENTION

This invention relates to a sleeve carton erecting, loading and sealing machine for packaging a plurality of articles in such cartons and, more particularly, to end panel folding and sealing apparatus which folds the end panels of the cartons against the carton dust flaps and presses the end panels and dust flaps together to seal the carton and complete the packaging operation.

Sleeve carton machines which erect folded sleeve carton blanks, load articles to be packed into the sleeve thus formed, and seal the dust flaps and end panels of the cartons together to form a package are used extensively in the beer and soft drink industries to package beverage cans in twelve packs and the like. These sleeve carton machines normally employ static folding bars for folding the end panels of the cartons against the carton dust flaps and pressing them together while the glue applied between the end panels and dust flaps sets and the cartons are sealed.

The sleeve carton machines which employ the static folding bars operate to carton packaging rates approaching 150 cartons per minute. However, with increased demands for beer and soft drink beverages the industry has a continuing need to increase the packaging rates of its machines so that each machine can package more articles. The static folding bars of the prior art machines present a problem. The static folding bars exert a drag on the end panels as the end panels are folded and pressed against the dust flaps by the static bars. This causes the cartons to be formed out of square and the end panels do not line up properly with the dust flaps and the sides of the cartons. This presents an aesthetic problem. The misalignment of the carton panels and flaps gives the carton a haphazard or poorly formed appearance to the consumer. In addition, corners of the end panels projecting beyond the side walls of the cartons can catch on other packages or objects. This interferes with the handling and stacking of such packages and can result in the tearing of the end panels.

The carton erecting, loading and sealing machine of the present invention is provided with a unique end panel folding and carton sealing assembly. The present invention eliminates the static folding bars and any need for an auxiliary end panel folding assembly for folding the end panels on machine shutdowns.

The end panel folding and carton sealing assembly of the present invention includes a pair of upper folding plates and a pair of lower folding plates. The plates are located on either side of and adjacent to the carton conveyor. Each folding plate is mounted through rotatable mountings to a pair of cranks which move the folding plates through a cycle wherein the plates fold the end panels against the dust flaps and press the end panels against the dust flaps while glue applied between the end panels and dust flaps sets. The motion imparted to the folding plates by the cranks during this folding and sealing cycle also moves the plates in a downstream direction while the plates are in contact with the end panels. This greatly reduces or eliminates the drag exerted on the end panels and has permitted an increase in operating speeds of such machines to 200 packages per minute without misalignment of the end panels.

Another advantage of the present invention is the elimination of any need for an auxiliary end panel folding mechanism. On normal shutdowns the drives of the folding plates are controlled to stop the folding plates at substantially the midpoints of their folding and sealing cycles thereby assuring that any carton in the folding and sealing station is sealed.

BRIEF DESCRIPTION OF THE DRAWINGS

Other objectives and advantages of the present invention will be more apparent from the following detailed description taken in conjunction with the accompanying drawings wherein:

FIGS. 3, 4 and 5 are elevation views of the folding and sealing assembly on one side of the carton conveyor showing the assembly at 90° intervals through the folding and sealing cycle;

DETAILED DESCRIPTION OF THE INVENTION

Figure 1:
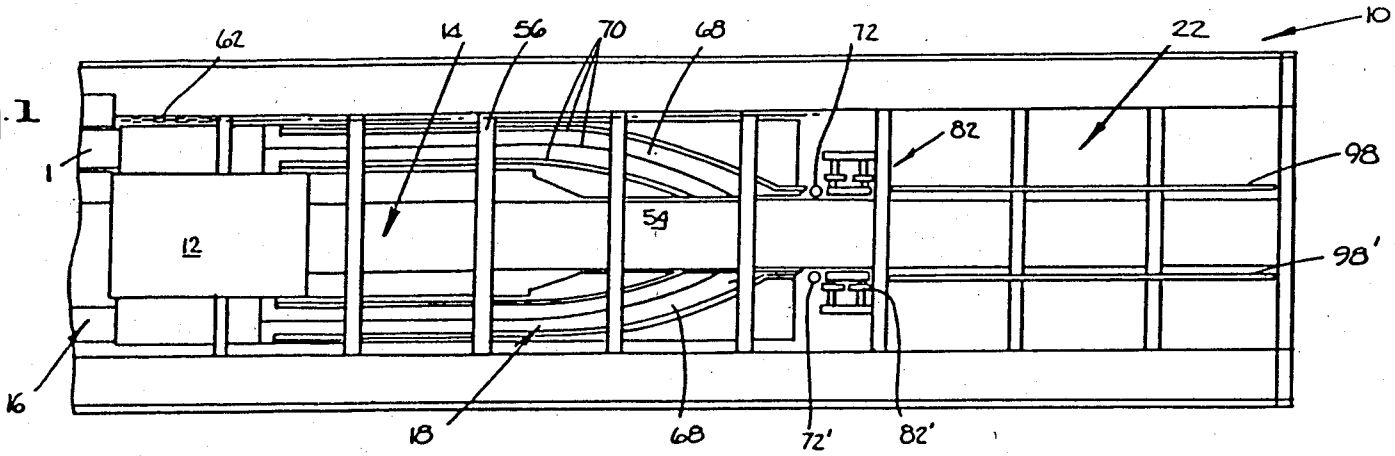
FIGS. 1 and 2 are schematic plan and elevation views of a carton erecting, loading and sealing machine employing the folding and sealing assembly of the present invention.
Figure 2:
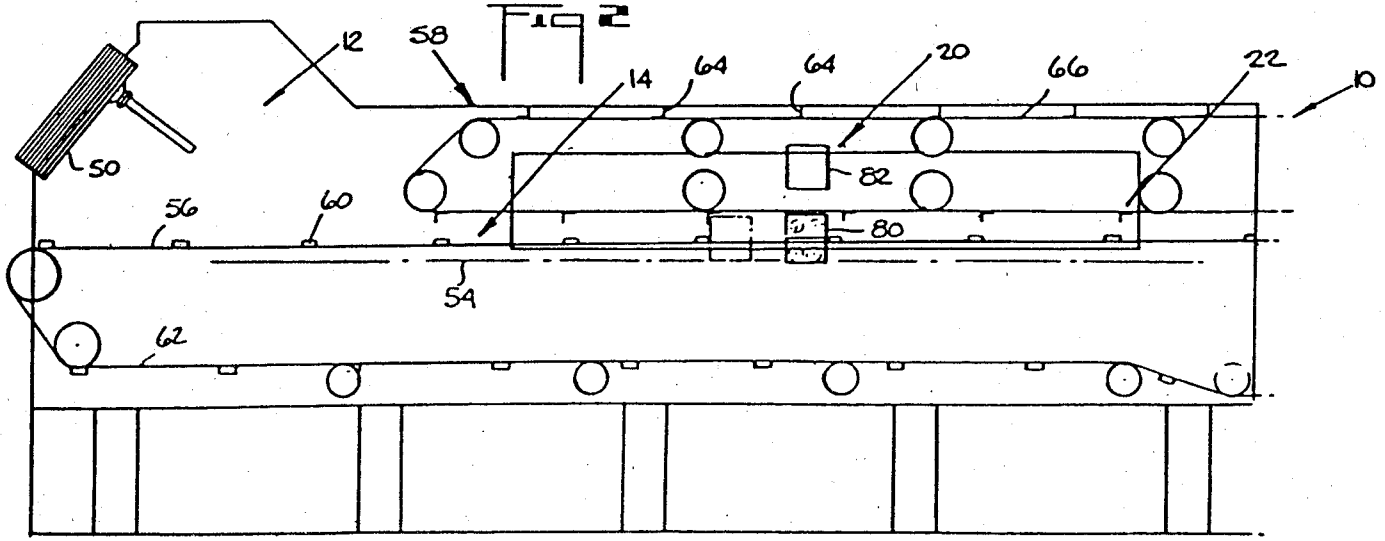

The schematic plan and elevation views of FIGS. 1 and 2 illustrate the different stations of a sleeve carton erecting, loading and sealing machine 10. The machine 10 includes a sleeve carton hopper feed station 12, a carton conveyor system 14, an article infeed station 16, an article loading station 18, a gluing and sealing station 20, and a discharge station 22.

Figure 8:
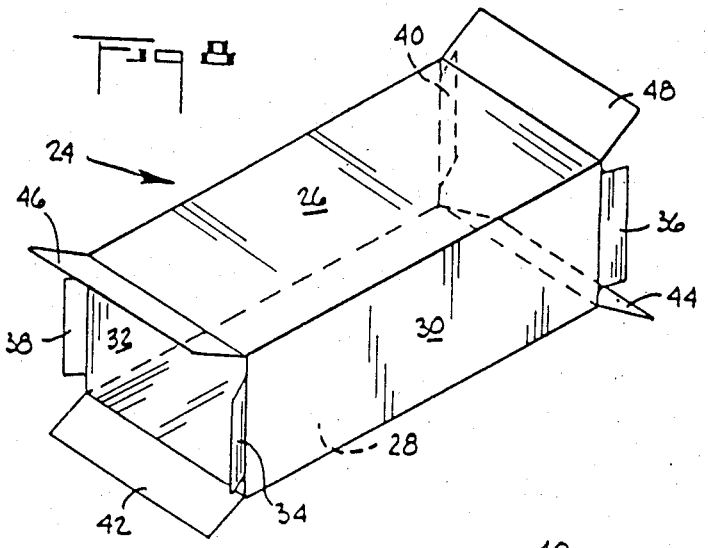
FIGS. 8, 9 and 10 are perspective views of a typical carton processed over the machine taken before entering the gluing and sealing station, as glue is being applied to the dust flaps, and after completion of the sealing operation, respectively.
Figure 9:
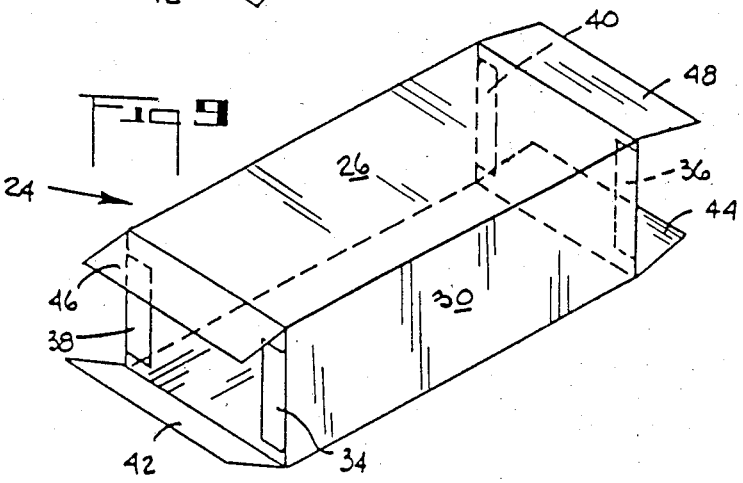
Figure 10:
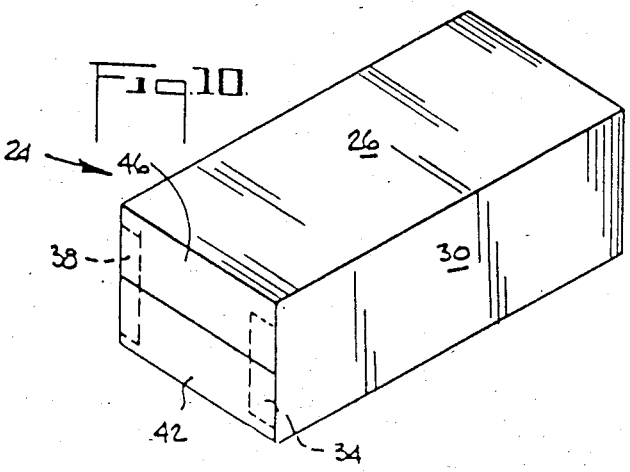

As shown in FIGS. 8–10 the sleeve cartons 24 each comprise a top panel 26, a bottom panel 28 and side panels 30 and 32 which are hingedly joined along fold lines to form a sleeve. In addition each carton has dust flaps 34, 36, 38 and 40 hingedly joined to the ends of the side panels and end panels 42, 44, 46 and 48 hingedly joined to the ends of the top and bottom panels. The dust flaps and end panels provide a means to close the ends of the cartons after the cartons have been loaded with the articles to be packaged.

All stations of the machine 10 are conventional state of the art stations except for the gluing and sealing station. The TARGETEER® and TARGETEER®-HIGH SPEED packaging machines of Manville Forest Products Corporation are typical of the machines which could employ the unique gluing and sealing station of the present invention and the operation of such a machine will now be described.

The sleeve cartons 24 are supplied to the macine 10 from the hopper feed station 12. The hopper feed station includes a hopper 50 where the sleeve cartons 24 are held in flat folded form. The flat folded sleeve cartons 24 are pulled from the hopper by a dispensing and opening machanism which delivers the opened sleeve cartons to the carton conveyor system 14. When the sleeve cartons 24 are opened, the dust flaps 34, 36, 38 and 40 project parallel to the side panels 30 and 32 and do not interfere with the loading of the sleeve carton. The lower end panels 42 and 44 are folded down and the upper end panels 46 and 48 are folded up and held back from the open ends of the sleeve carbon by lower and upper folding bars to permit the loading of articles into the sleeve cartons at the article loading staton 18.

The sleeve carton conveyor system 14 includes a stationary center metal bed plate 54, a lower flight bar conveyor 56 and an upper flight lug conveyor 58. The center metal bed plate 54 extends from the hopper feed station 12 downstream through the discharge station 22. The lower flight bar conveyor 56 comprises series of spaced flight bars 60 which contact the trailing side panels of the sleeve cartons. The flight bars 60 are connected by a pair of drive chains 62, are spaced above the bed plate 54, and move downstream over the upper surface of the bed plates 54 conveying the sleeve cartons 24 through the machine 10 from the feed hopper station 12 to the discharge station 22. The upper flight lug conveyor 58 includes a series of pairs of lugs 64 with each pair of lugs located directly above a flight bar 60 of the flight bar conveyor. The pairs of lugs are joined by drive chains 66. The lugs 64 engage the trailing side panels of the sleeve cartons adjacent their upper edges and together with the flight bars 60 convey the sleeve cartons through the machine.

The article infeed conveyor 16 delivers the articles to be packaged into the article loading station on either side of the hopper feed station. The article loading station 18 includes a pair of slide plates 68 located on opposite sides of the hopper feed station 12 and carton conveyor system 14. The slide plates are each provided with sets of guide ribs 70 which project beyond the surfaces of the slide plates and extend from the article infeed conveyor to the location where the articles are loaded into the open ends of the sleeve cartons. As shown in FIGS. 1 and 2 the flight bars 60 extend across the slide plates 68. Accordingly, as the articles to be loaded into the carton sleeve are delivered to the article loading station by the infeed conveyor 16, the articles are engaged by the flight bars 60 and moved downstream. The curvature of the guide ribs 70 guides the articles toward the carton conveyor system 14 as the flight bars 60 move the articles downstream. At the location where the guide ribs 70 terminate adjacent the sides of the bed plates 54, the downstream movement of the flight bars 60 together with the guide ribs 70 causes the articles to be loaded into the open ends of the sleeve cartons 24 being conveyed by the flight bars.

After the articles are loaded into each sleeve carton 24 and as the loaded sleeve carton leaves the loading station 18 the end panels are released by the upper and lower fold back bars. The dust flaps and end panels are then closed and sealed together in the gluing and sealing station 20 and the finished package is then delivered into the discharge station 22 where the cartons 24 are removed to be stored or shipped. The apparatus of the gluing and sealing station and its function will now be described in detail.

As shown in FIGS. 3 through 7, the gluing and sealing station 20 includes a pair of dust flap tucking fingers 72, 72' a pair of static dust flap folding rods 74, 74', a pair of lower end panel folding rods 76, 76' two pair of glue guns 78, 78', a pair of lower end panel folding assemblies 80, 80', and a pair of upper end panel folding assemblies 82, 82'.

The dust flap tucking fingers 72, 72' and the static dust flap folding rods 74, 74' cooperate to fold the leading and trailing dust flaps of each carton so that the dust flaps on each end of the carton extend inward toward each other as illustrated in FIG. 9. The static dust flap folding rods 74, 74' are located directly opposite each other on either side of the bed plate 54. The rods 74, 74' are mounted adjacent the lateral edges of the bed plate but are spaced above those edges a distance approximately equal to half the height of the dust flaps. Adjacent the leading ends of the rods 74, 74' are mounted the pair of tucking fingers 72, 72'. The tucking fingers rotate about a vertical axis and in a downstream direction as the fingers pass adjacent the edges of the bed plate 54. The height of the tucking fingers above the bed plate is also approximately half the height of the dust flaps.

The pair of static lower end panel folding rods 76, 76' are mounted directly opposite each other on opposite sides of and spaced laterally from the edges of the bed plate 54. The leading ends of the folding rods 76, 76' are turned down below the horizontal plane of the bed plate so that the rods 76, 76' can pass under the lower end panels 42 and 44 of the sleeve carton 24. The main portions of the folding rods 76, 76' extend horizontally above the horizontal plane of the bed plate a sufficient distance to raise the lower end panels to an angle of about 20° above the horizontal.

The two pair of glue guns 78, 78' are mounted directly opposite each other on opposite sides of and spaced laterally from the edges of the bed plate 54. The height of the glue guns above the horizontal plane of the bed plate 54 is approximately half the height of the sleeve carton 24 and the nozzles of each pair of the guns are directed substantially horizontally inward toward the other pair of glue guns. The spacing between the glue guns of each pair equals the distance between the midpoints of the dust flaps. The glue guns are mounted in the gluing and sealing station at locations which align the glue guns with the midpoints of the dust flaps just prior to contact between the lower end panels 42 and 44 and the lower end panel folding assemblies 80, 80'.

Figure 5:
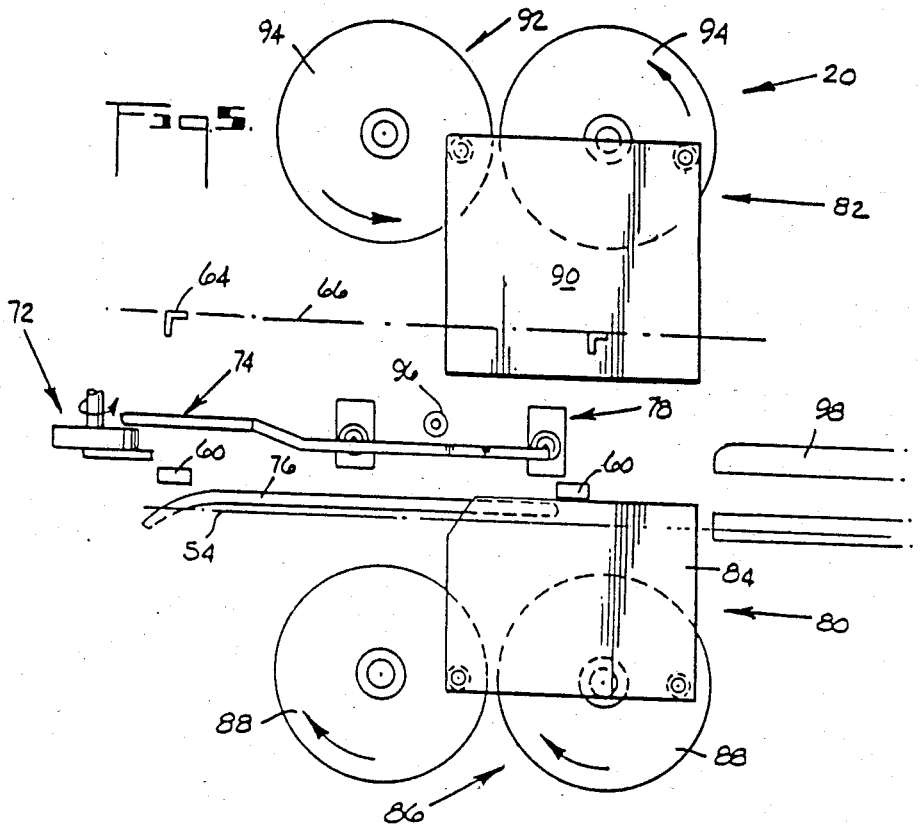

Each of the lower end panel folding assemblies 80, 80' include a folding plate 84, 84' and a pair of crank assemblies 86, 86'. The folding plates are flat, substantially equal in length to the width of the sleeve cartons, and are rotatably mounted at each lower corner to the crank arms 88, 88' of the crank assemblies. The plates 84, 84' are mounted to move in vertical planes adjacent the lateral edges of the bed plate 54 between the end panel folding rods 76, 76' and the dust flap folding rods 74, 74. The cranks arms of each crank of the lower panel folding assemblies 80, 80' are equal in length and extend parallel to each other. Accordingly, the folding plates 84, 84' af lower end panel folding assemblies 80, 80' move in unison from positions corresponding to that shown in FIG. 3 where the plates are at the beginning of their folding and sealing cycle, to a second position as shown in FIG. 4 midway through the folding and sealing cycle where the folding plates of the upper and lower assemblies almost meet, to a third position as shown in FIG. 5 at the end of the folding and sealing cycle. The folding plates 84, 84' then pass through the lower 180° of their cycle to return to the position shown in FIG. 3.

Each of the upper end panel folding assemblies 82, 82' including a folding plate 90, 90' and a pair of crank assemblies 92, 92'. The folding plates are flat, substantially equal in length to the width of the sleeve cartons, and are rotatably mounted at each upper corner to the crank arms 94, 94' of the crank assemblies 92, 92'. The plates 90, 90' are mounted to move in vertical planes directly above the lower folding plates 84, 84'. The crank arms 94, 94' of each crank of the crank assemblies 92, 92' are equal in length to each other and the lengths of the crank arms of the lower crank assemblies. The crank arms of the upper crank assemblies all extend parallel to each other. However the cycles of crank arms 94, 94' of the upper crank assemblies follow the crank arms 88, 88' of the lower crank assemblies by a number of degrees sufficient to allow the folding of the lower end panels 42 and 44 by the lower folding plates 84, 84' to lead the folding of the upper end panels 46 and 48 by the upper folding plates 90. Typically the lower crank arms lead the upper crank arms by about five to fifteen degrees. As best seen in FIG. 4, the crank arms 94 of the upper crank assemblies 92 are about 10° from vertical while the crank arms 88 of the lower crank assemblies are vertical.

The folding plates 90, 90' of the upper folding assemblies move in unison from positions corresponding to that shown in FIG. 3 where the folding plates are at the beginning of their folding cycle, to the midpoint of their folding cycle as shown in FIG. 4 where the upper and lower folding plates almost meet, to the end of the folding cycle as shown in FIG. 5. The folding plates then pass through the upper return portion of their cycle to the position shown in FIG. 3.

The folding and sealing portion of the packaging operation is as follows. After each sleeve carton 24 has been loaded with articles, the carton passes from the loading station 18. As the sleeve carton passes from the loading station the dust flaps and end panels are released and the carton appears as illustrated in FIG. 8.

The flight bars 60 convey the sleeve carton to the gluing and sealing station 20. As the sleeve carton enters the gluing and sealing station the leading dust flaps 34, 36 are contacted by dust flap folding rods 74, 74' and folded inward to extend upstream toward the trailing dust flaps. The trailing dust flaps 38, 40 are then folded into place by the tucking fingers 72, 72' and held in place by the tucking fingers until the trailing dust flaps also pass downstream behind the folding rods 74, 74'. The rotations of the tucking fingers are synchronized with the movement of the flight bars so that the fingers pass through the folding portions of their cycles as the trailing dust flaps are opposite the tucking fingers.

Figure 6:
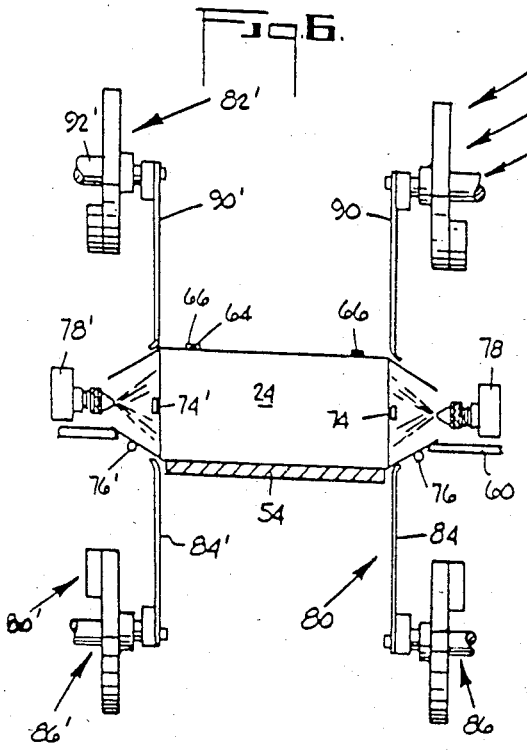
FIGS. 6 and 7 are elevation views of the gluing and sealing station taken from the downstream side of the station with a sleeve carton in the station.

The lower end panels 42, 44 then ride up on the lower end panel folding rods 76, 76' and the carton appears as illustrated in FIGS. 6 and 9. The lower end panels are raised about 20° above the horizontal by the lower end panel folding rods and gravity causes some deflection of the upper end panels 46, 48 downward. With the lower end panels folded and held by the lower end panel folding rods 76, 76', the lower end panels retain the lower ends of the dust flaps in place.

The passage of the sleeve carton into the gluing and sealing station is detected by an electronic eye 96 which actuates the glue guns 78, 78' to apply glue to the dust flaps at the position shown in FIG. 6 just prior to contact between the lower end panels and the lower folding plates 84, 84'.

Figure 7:
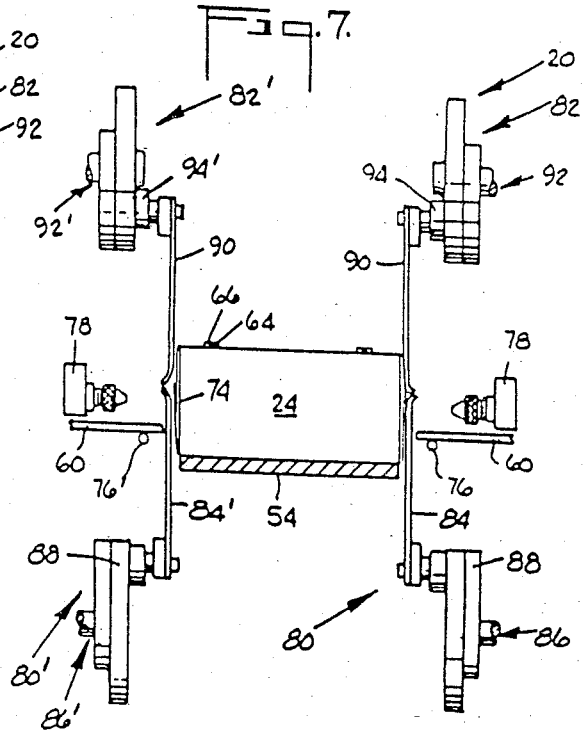

Once the glue has been applied to the dust flaps, the lower end panels 42 and 44 are engaged by the lower folding plates 84, 84' and folded into place as the lower folding plates move upward and downstream from the position illustrated in FIGS. 3 and 6 to the positions illustrated in FIGS. 4 and 7. The upper end panels 46, 48 are contacted by the upper folding plates 90, 90' after the lower folding plates have started folding the lower end panels up against the dust flaps. The upper folding plates fold the upper end panels down against the dust flaps are the folding plates move downward and downstream from the position shown in FIGS. 3 and 6 to the positions shown in FIGS. 4 and 7.

Since the lower ends of the dust flaps are held in place by the dust flap folding rods 74, 74' and the upwardly inclined lower end panels 42, 44 riding on the lower end panel folding rods 76, 76' prior to the folding of the lower end panels by the lower end panel folding plates, the lower ends of the dust flaps do not interfere with the closing of the lower end panels by the folding plates. Since the folding of the lower end panels precedes the folding of the upper end panels by the upper end panel folding plates, the dust flaps are moved and held in by the lower end panels so that the dust flaps do not interfere with the closing of the upper end panels by the upper folding plates. While examples of the cycle lead required to achieved this result have been disclosed above, the cycle lead of the lower folding assemblies with respect to the upper folding assemblies only need to be great enough to assure that the dust flaps do not interfere with the closing of the upper end panels.

As the upper and lower folding plates 84, 84' and 90, 90' move through the folding and sealing portions of their cycles illustrated at 90° intervals in FIGS. 3, 4 and 5, the end panels are folded against the dust flaps and the end panels and dust flaps are pressed together between the folding plates and the articles within the carton while the glue sets.

The cycles of the folding and sealing assemblies are synchronized with the travel of the flight bars so that the cycle just described is repeated as each sleeve carton passes through the gluing and sealing station. In addition the controls of the machine are set so that the folding plates 84, 84' and 90, 90' stop in the positions shown in FIGS. 4 and 7 during a normal shutdown. In this way an carton then in the gluing and sealing station is sealed and no auxiliary folding and sealing assemblies are required.

As the carton is conveyed from the gluing and sealing station 20 it appears as shown in FIG. 10. The sleeve carton passes from the gluing and sealing station into the discharge station where the ends of the carton are contacted by compression bars 98, 98'. The compression bars are mounted opposite each other, adjacent and downstream from the gluing and sealing station and adjacent the edges of the bed plate.

Having described the preferred embodiment of our invention in detail, what we desire to claim and protect by Letters Patent is:

1. In a packaging machine a method of folding closure flaps in sequential fashion in a continuously moving line of open ended cartons advancing in a predetermined direction without physically adjusting the normal position or function of machine piece parts comprising the steps of folding the flaps by continuously cycling movable closure elements in a vertical plane, said elements being movable in said plane to develop a vertical stroke component defining an open flap position and a closed flap position, and controlling the stroke of the closure elements relative to the moving line of cartons so that when the advance of the cartons is stopped the flap folding cycle stops with the closure elements in the closed flap position.

2. The method of claim 1 plus the step of cycling closure elements in pairs.

3. The method of claim 1 plus the step of cycling pairs of closure elements on opposite sides of said moving line of cartons in parallel, vertical planes.

4. The method of claims 2 or 3 plus the step of providing upper and lower closure elements so that the closed flap position of one closure element corresponds to one extreme of its vertical stroke while the closed flap position of the other closure element corresponds to the opposite extreme of its vertical stroke.

* * * * *